United States Patent [19]

Ona et al.

[11] Patent Number: 4,973,620

[45] Date of Patent: Nov. 27, 1990

[54] FIBER-TREATMENT AGENT COMPOSITION

[75] Inventors: Isao Ona; Masaru Ozaki; Hidetoshi Kurusu, all of Chiba Prefecture, Japan

[73] Assignee: Toray Silicone Company, Ltd., Tokyo, Japan

[21] Appl. No.: 357,562

[22] Filed: May 26, 1989

[30] Foreign Application Priority Data

May 30, 1988 [JP] Japan ..... 63-132154

[51] Int. Cl.[5] ..... C08K 5/09

[52] U.S. Cl. ..... 524/292; 528/26; 528/26.5; 556/401; 556/419; 106/287.11; 524/287; 524/290; 524/293; 524/320

[58] Field of Search ..... 556/419, 401; 528/26, 528/26.5; 106/287.11; 524/287, 290, 292, 293, 320

[56] References Cited

U.S. PATENT DOCUMENTS 4,247,592 1/1989 Kalinowski ..... 428/266

*Primary Examiner*—Melvyn I. Marquis

*Attorney, Agent, or Firm*—George A. Grindahl

[57] ABSTRACT

A composition and method for treating fibers is based on a mixture of an organopolysiloxane having at least one amino-substituted hydrocarbon radical directly bonded to a silicon atom and a carboxylic acid containing at least one ethylene oxide unit. The carboxylic acid reacts with the amino radicals to reduce yellowing and oxidation of the fiber treatment. The composition and method provide non-yellowing fibers and a treatment agent that does not gel during use, such as when exposed to carbon dioxide and/or used to treat carbon fibers.

8 Claims, No Drawings

FIBER-TREATMENT AGENT COMPOSITION

BACKGROUND OF THE INVENTION

The present invention relates to a fiber-treatment agent composition. Fiber-treatment agents based on organopolysiloxane containing the group represented by the formula $-CH_2CH_2CH_2NHCH_2CH_2NH_2$ have been used to impart lubricity to fibrous materials composed of natural fibers such as cotton, flax, silk, wool, angora, and mohair; regenerated fibers such as rayon and Bemberg; semisynthetic fibers such as acetate; and synthetic fibers such as polyesters, polyamides, polyacrylonitriles, polyvinyl chlorides, Vinylon, polyethylenes, polypropylenes, and Spandex. Refer to Japanese Patent Publication Number 57-43673 (43,673/82). However, fibers treated with such an organopolysiloxane containing the group represented by the formula $-CH_2CH_2CH_2NHCH_2cH_2NH_2$ are subject to yellowing due to a spontaneous oxidation occurring with time. Moreover, when continuous lubrication using rollers is carried out from a bath containing such an organopolysiloxane lubricant, moisture and carbon dioxide are absorbed from the atmosphere, and a white turbidity appears in the bath and the precipitation of a gel occurs. Furthermore, when such an organopolysiloxane is used for high-temperature oiling or lubrication as in the treatment of carbon fiber, for example, polyacrylonitrile-based carbon fiber, the organopolysiloxane is degraded to a gum, which sticks on the rollers, etc. This has the unfortunate effect of causing the fiber to snap.

BRIEF SUMMARY OF THE INVENTION

The present invention, having as its object a solution to the aforementioned problems, introduces a fiber-treatment agent which not only imparts excellent lubrication and softness, but which also does not yellow the fibrous material and is not subject to gelation or gum formation or the development of a white turbidity during storage, treatment, or heating.

The aforesaid object is achieved by means of a fiber-treatment agent composition comprising (A) an organopolysiloxane represented by the formula

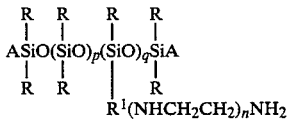

wherein R is a monovalent hydrocarbon group; A is an R group or a group with the formula $-R^1(NHCH_2,CH_2,)_aNH_2,$; $R^1$ is a divalent hydrocarbon group; a=zero to 10; p and q are zero or more; with the proviso that p+q=10 to 2,000, and there is at least one $-R^1(NHCH_2,CH_2,)_aNH_2$ group in each molecule; and (B) 0.2 to 5.0 moles, per 1 mole of primary and secondary amino groups in component (A), of a compound represented by the formula $R^2,O(C_2H_4O)_bR^3COOH$ wherein $R^2$ is a monovalent hydrocarbon group having 10 to 20 carbon atoms, b is at least one, and $R^3$ is a divalent hydrocarbon group.

DETAILED DESCRIPTION OF THE INVENTION

To explain the preceding in greater detail, component (A) is an organopolysiloxane as represented by the following general formula and which has at least one $-R^1(NHCH_2CH_2)_aNH_2$ group in each molecule.

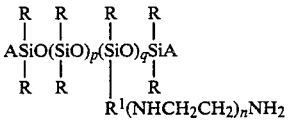

In the above organopolysiloxane formula R is a monovalent hydrocarbon group; A is an R group or a group with the formula $-R^1(NHCH_2CH_2)_aNH_2$; $R^1$ is a divalent hydrocarbon group; a=zero to 10; p and q are zero or more; with the proviso that p+q=10 to 2,000.

R in the above formula is a monovalent hydrocarbon group, as exemplified by alkyl groups such as methyl, ethyl, propyl, and butyl; aralkyl groups such as 2-phenylethyl and 2-phenylpropyl; halogen-substituted alkyl groups such as 3,3,3-trifluoropropyl; alkenyl groups such as vinyl, propenyl, and butadienyl; cycloalkyl groups such as cyclohexyl; aryl groups such as phenyl and naphthyl; and alkayl groups such as tolyl and xenyl. Alkyl, alkenyl, and aryl groups are preferred. Furthermore, within a single molecule, R may be only a single species or may comprise different species.

$R^1$ in the above formula is a divalent hydrocarbon group, and examples in this regard are alkylene groups such as methylene, n-propylene, n-butylene, isobutylene, and isopropylene; arylene groups such as phenylene; and alkylenearylene groups such as ethylenephenylene. Alkylene is typically selected from among these. The value of a is zero to 10, and p and q are numbers with values of zero or more.

A is $-R^1(NHCH_2CH_2)_aNH_2$ or an R group. When both of the two A groups are $-R^1(NHCH_2CH_2)_aNH_2$, q may be zero.

Furthermore, the value of p+q is to be 10 to 2,000. The basis for this is as follows. Only a meager softness and smoothness are imparted to the fibrous material at values below 10, while emulsification becomes difficult at values in excess of 2,000.

Considering the structure of component (A), it is the diorganopolysiloxane moiety which functions to develop softness and smoothness, while the amino group moiety functions to form a salt with component (B).

Component (B) comprises a compound as represented by the general formula $R^2O(C_2H_4O)_bR^3COOH$. It forms a salt with the amino groups in component (A), or forms an amide bond with the amino groups in component (A) according to the heating conditions, and functions to improve both the stability of the composition and the resistance to yellowing. In addition, this component functions to improve the emulsion stability when the composition under consideration is emulsified.

The group $R^2$ in the above formula is a monovalent hydrocarbon group having 10 to 20 carbon atoms, and examples in this regard are branched alkyl groups and linear alkyl groups such as the undecyl group, lauryl group, myristyl group, and cetyl group; alkenyl groups such as the oleyl group; alkaryl groups such the octylphenyl group and nonylphenyl group; and aralkyl groups such as the phenyloctyl group. While b should have a value of at least one, values of 3 to 15 are preferred. $R^3$ is a divalent hydrocarbon group, and examples here are alkylene groups such as methylene, ethylene, propylene, and isobutylene, as well as alkylenearylene groups such as the —$C_2H_4C_6H_4$— group. Alkylene groups are preferred, and the methylene group is particularly preferred.

Component (B) can be obtained, for example, by an addition reaction between ethylene oxide and stearyl alcohol or octylphenol, followed by carboxylation by a dehydrochlorination reaction with monochloroacetic acid or similar compounds.

The component (B) under consideration is employed in a quantity giving 0.2 to 5.0 moles per 1 mole primary and secondary amino groups in component (A). Yellowing prevention and the prevention of the development of gel and white turbidity do not appear at less than 0.2 moles. Furthermore, the hand becomes poor in excess of 5 moles.

The composition of the present invention may be prepared by simply mixing components (A) and (B) to uniformity; however, mixing while heating at 40 to 180 degrees Centigrade is preferred.

The composition of the present invention can be directly adhered as such on fibrous materials, but treatment may also be conducted with it dissolved in an organic solvent, for example, toluene, xylene, benzene, n-hexane, heptane, acetone, methyl ethyl ketone, methyl isobutyl ketone, ethyl acetate, butyl acetate, mineral turpentine, perchloroethylene, trichloroethylene, etc. Treatment may also be conducted with it emulsified using a cationic or nonionic surfactant.

Examples of cationic surfactants in this regard are quaternary ammonium hydroxides (and salts thereof) such as octyltrimethylammonium hydroxide, dodecyltrimethylammonium hydroxide, hexadecyltrimethylammonium hydroxide, octyldimethylbenzylammonium hydroxide, decyldimethylbenzylammonium hydroxide, didodecyldimethylammonium hydroxide, dioctadecyldimethylammonium hydroxide, beef tallow trimethylammonium hydroxide, and cocotrimethylammonium hydroxide.

Examples of nonionic surfactants in this regard are polyoxyalkylene alkyl ethers, polyoxyalkylene alkylphenol ethers, polyoxyalkylene alkyl esters, polyoxyalkylene sorbitan alkyl esters, polyethylene glycols, polypropylene glycols, and diethylene glycol.

The surfactant is preferably used at 5 to 50 weight parts and more preferably at 10 to 30 weight parts per 100 weight parts organopolysiloxane comprising component (A).

While water may be used in arbitrary quantities and its use quantity is not crucial, in general it will be used in a quantity affording an organopolysiloxane concentration of 5 to 60 weight%. It is particularly preferred that water be used in a quantity giving an organopolysiloxane concentration of 10 to 40 weight%.

To emulsify the composition of the present invention, the surfactant as described above and a small quantity of the water are added to and mixed to homogeneity into the mixture of components (A) and (B). This may then be emulsified using an emulsifying device such as an homogenizer, colloid mill, line mixer, propeller mixer, vacuum emulsifier, or similar devices.

Furthermore, the composition of the present invention may also contain other additives as known to the art, such as antistatics, softeners, creaseproofing agents, heat stabilizers, flame retardants, etc.

The fibrous material can be treated using methods such as spray adhesion, roll application, brushing, immersion, dipping, etc. The add-on or uptake quantity will vary with the fibrous material and thus cannot be rigorously specified; however, in general it will fall within the range of 0.01 to 10.0 weight% as organopolysiloxane fraction based on fibrous material. The fibrous material is then allowed to stand at the ambient temperature, subjected to a hot air flow, or is heat treated.

The fibrous material may be composed of, for example, natural fiber such as wool, silk, flax, cotton, angora, mohair, and asbestos; regenerated fiber such as rayon and Bemberg; semisynthetic fiber such as acetate; synthetic fiber such as polyesters, polyamides, polyacrylonitriles, polyvinyl chlorides, Vinylon, polyethylenes, polypropylenes, and Spandex; and inorganic fiber such as glass fibers, carbon fibers, and silicon carbide fibers. It may take the form of, for example, the staple, filament, tow, top, or yarn, and in its structure may be, for example, a weave, knit, or nonwoven fabric.

EXAMPLES

The present invention is explained in greater detail, but not limited, in the following by illustrative examples. In the examples, unless specified otherwise, parts = weight parts, % = weight%, and the viscosity is the value measured at 25 degrees Centigrade.

EXAMPLE 1

Treatment baths (a) through (f) were prepared by blending toluene siloxane A and compound B as reported in Table 1.

(siloxane A)—

$$(CH_3)_3SiO\{(CH_3)_2SiO\}_{400}\{CH_3SiO\}_8Si(CH_3)_3$$
$$\qquad\qquad\qquad\qquad\qquad\qquad |$$
$$\qquad\qquad\qquad\qquad\qquad\quad C_3H_6$$
$$\qquad\qquad\qquad\qquad\qquad\qquad |$$
$$\qquad\qquad\qquad\qquad\quad HNCH_2CH_2NH_2$$

(compound B)—$C_{13}H_{27}O(C_2H_4O)_3CH_2COOH$

TABLE 1

| Components | formulation (parts) | | | | | |
|---|---|---|---|---|---|---|
| | (a) | (b) | (c) | (d) | (e) | (f) |
| Siloxane A | 9.2 | 9.2 | 9.2 | 9.2 | 9.2 | 0 |
| Compound B | 6.3 | 2.1 | 1.0 | 0.2 | 0 | 0 |
| Toluene | 985.5 | 988.7 | 989.8 | 990.6 | 990.8 | 1000 |
| molar ratio: compound B to amino groups in siloxane A | 3 | 1 | 0.5 | 0.1 | 0 | — |

Fluorescent-whitened 100% cotton broadcloth (50 cm × 50 cm) was immersed for 10 seconds in the particular treatment bath. After removal, a 100% expression ratio was obtained using squeeze rollers. The fabric was subsequently spread out and dried at room temperature (siloxane A add-on=0.9%), and was then heat-treated for 5 minutes in a hot-air drier at 150 degrees Centigrade and removed.

The broadcloth fabric was then cut in two through the middle, and the degree of yellowing (ΔYI) due to the heat treatment was determined on one piece using an SM Color Computer from the Suga Kikai Company. Using the remaining treated fabric, the flexural rigidity, which is indicative of the softness, was determined by the Clark method, and the crease resistance was measured by the Monsanto method (only in the warp direction for each fabric). In addition, a global evaluation as men's shirting was carried out base on the following criteria, and these results are reported in Table 2.

+ = good hand (flexural rigidity), no yellowing, crease resistance also excellent: entirely suitable as a treatment agent for men's shirting − = globally evaluated as somewhat unsatisfactory × = globally evaluated as unsuitable as a treatment agent for men's shirting (strong yellowing, also excessively slick)

The results are reported in Table 2. The treatment agent of the present invention produced no yellowing, gave an excellent softness and crease resistance, and was very suitable for men's shirting.

TABLE 2

| Treatment Bath | | yellowing (ΔYI) | flexural rigidity (mm) | crease resistance (%) | global evaluation for men's shirting |
|---|---|---|---|---|---|
| present invention | (a) | 1.21 | 36 | 83 | + |
| | (b) | 1.18 | 34 | 84 | + |
| | (c) | 1.20 | 35 | 85 | + |
| | (d) | 1.29 | 34 | 85 | + |
| comparison examples | (e) | 8.01 | 37 | 78 | x |
| | (f) | — | 47 | 70 | x |

EXAMPLE 2

The following treatment liquids were prepared in order to investigate the high-temperature stability which is an essential property in lubricants for polyacrylonitrile-based carbon fiber. The components are given in Table 3, and the siloxane A was the same as used in Example 1 (carboxylic acid/amino groups in siloxane A molar ratio = 1).

TABLE 3

| Components | formulation (parts) | | | | | |
|---|---|---|---|---|---|---|
| | (g)* | (h)* | (i) | (j) | (k) | (l) |
| Siloxane A | 75.0 | 81.3 | 96.0 | 98.0 | 98.7 | 100 |
| Compound B-1** | 25.0 | — | — | — | — | — |
| Compound B-2** | — | 18.7 | — | — | — | — |
| Caproic Acid | — | — | 4.0 | — | — | — |
| Acetic Acid | — | — | — | 2.0 | — | — |
| Formic Acid | — | — | — | — | 1.3 | — |
| None | — | — | — | — | — | 0 |

*This invention.

**Compound B-1 = $C_{13}H_{27}(C_2H_4O)_7CH_2COOH$ Compound B-2 = $C_8H_9(C_6H_4)O(C_2H_4O)_5CH_2COOH$

PREPARATION OF THE TREATMENT LIQUIDS

Siloxane A was placed in a 300 cc four-neck flask, the carboxylic acid as specified in Table 3 was then added, and a nitrogen seal was set up. Mixing to homogeneity was subsequently carried out at 140 to 150 degrees Centigrade. The obtained treatment liquids (g) through (1) were emulsified as detailed below to prepare the respective emulsions.

| Emulsion components: | |
|---|---|
| treatment liquid (g) through (l) | 20.0 parts |
| polyoxyethylene (6 mole) ether of trimethylnonanol | 4.0 parts |
| polyoxyethylene (10 mole) ether of trimethylnonanol | 1.0 part |
| water | 75.0 parts |

EMULSIFICATION METHOD:

The two emulsifying agents were added to the treatment liquid (g) through (1), and this was mixed with a stirrer for 10 minutes. Five parts water was then added, followed by stirring for an additional 10 minutes. The remaining 70 parts water was then added, and mixing for 30 minutes afforded the emulsion.

4 g of the particular emulsion prepared as described above was placed in an aluminum cup (diameter = 5 cm, depth = 1.5 cm), and a gelation test was conducted by varying the time held at 150 degrees Centigrade. Evaluation was conducted as follows.

+ = remains as an oil, almost no change in viscosity, no gel development

− = substantial increase in viscosity, partial gel development

× = completely gelled, no longer fluid, converted to a strongly sticky gel

These results are reported in Table 4. The treatment agent composition of the present invention gave unusually good results and did not undergo gelation.

TABLE 4

| Treatment Liquid | | Holding Time in Hours at 150 degrees Centigrade | | |
|---|---|---|---|---|
| | | 1 | 5 | 8 |
| Present Invention | (g) | + | + | + |
| | (h) | + | + | + |
| Comparison Examples | (i) | + | − | x |
| | (j) | + | x | x |
| | (k) | + | x | x |
| | (l) | + | x | x |

EXAMPLE 3

Treatment baths were respectively prepared by the addition of 95 parts water to 5 parts of the emulsion of (g) or (1) as prepared in Example 2. A commercial fluorescent whitened 100% cotton broadcloth (30 cm × 30 cm) was dipped into each treatment bath for 10 seconds.

After expressing to a 100% expression ratio on a mangle roll, drying was carried out at room temperature (silicone uptake = 1%). This was followed by heat treatment by placing the fabric in an oven for 3 minutes at 130 degrees Centigrade. The hand of this treated fabric was then examined sensorially. A 5 cm × 10 cm specimen was also cut from the treated fabric. While half was covered with black paper, the degree of yellowing was evaluated (ranked) using a discoloration/-fading gray scale based on JIS L-0804 upon exposure to light for 3 hours in a Fade-0-Meter lightfastness measurement instrument.

According to Table 5, the fabric treated with the treatment agent of the present invention gave excellent results, with an excellent hand and little yellowing due to light.

TABLE 5

| Treatment Liquid | | Hand | Yellowing (rank) by Fade-O-Meter Exposure |
|---|---|---|---|
| Present Invention | (g) | soft, but not limp; very suitable as broadcloth; appropriate degree of slickness | 4 |
| Comparison Examples | (l) | soft, but not limp; very suitable as broadcloth; appropriate degree of slickness | 2 |

TABLE 5-continued

| Treatment Liquid | Hand | Yellowing (rank) by Fade-O-Meter Exposure |
|---|---|---|
| no treat-ment | hard, the hand is very poor, also lacking in resilience | 4 |

EFFECTS OF THE INVENTION

The present invention introduces a fiber-treatment agent which can impart an excellent lubricity and softness without causing the fibrous material to yellow, and which does not undergo gelation or gum formation or the development of white turbidity during storage, heating, or treatment. In addition, the composition of the present invention is easily emulsified, and the emulsions so prepared are very stable.

That which is claimed is:

1. A fiber-treatment agent composition comprising (A) an organopolysiloxane represented by the formula

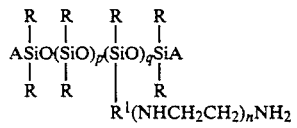

wherein R is a monovalent hydrocarbon group; A is a R group or a group with the formula $-R^1(NHCH_2CH_2)_aNH_2$; $R^1$ is a divalent hydrocarbon group; a = zero to 10;p and q are zero or more; with the proviso that p + q = 10 to 2,000, and there is at least one $-R^1(NHCH_2CH_2)_aNH_2$ group in each molecule; and (B) 0.2 to 5.0 moles, per 1 mole of primary and secondary amino groups in component (A), of a compound represented by the formula $R^2O(C_2H_4O)_bR^3COOH$ wherein $R^2$ is a monovalent hydrocarbon group having 10 to 20 carbon atoms, b is at least one, and $R^3$ is a divalent hydrocarbon group.

2. A fiber-treatment agent composition according to claim 1 wherein (A) has the formula

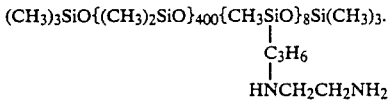

3. A fiber-treatment agent composition according to claim 1 wherein (B) has the formula $R^2O(C_2H_4O)_bCH_2COOH$.

4. A composition according to claim 1 wherein each R denotes a methyl group.

5. A process for providing treated fibers, said process comprising adhering the fiber-treatment agent composition of claim 1 to said fibers and recovering treated fibers having less yellowing than fibers similarly treated with a composition comprising only component (A).

6. A process for providing treated fibers, said process comprising adhering the fiber-treatment agent composition of claim 2 to said fibers and recovering treated fibers having less yellowing than fibers similarly treated with a composition comprising only component (A).

7. A process for providing treated fibers, said process comprising adhering the fiber-treatment agent composition of claim 3 to said fibers and recovering treated fibers having less yellowing than fibers similarly treated with a composition comprising only component (A).

8. A process for providing treated fibers, said process comprising adhering the fiber-treatment agent composition of claim 4 to said fibers and recovering treated fibers having less yellowing than fibers similarly treated with a composition comprising only component (A).

* * * * *